US005341584A

United States Patent [19]

Paris et al.

[11] Patent Number: 5,341,584

[45] Date of Patent: Aug. 30, 1994

[54] SKI BOOT HAVING A CLOSURE DEVICE

[75] Inventors: Jean Paris, Sevrier; Jean-Pierre Chemello, Annecy-Le-Vieux, both of France

[73] Assignee: Salomon S.A., Metz-Tessy, France

[21] Appl. No.: 79,198

[22] Filed: Jun. 21, 1993

[30] Foreign Application Priority Data

Jun. 22, 1992 [FR] France ..... 92 07761

[51] Int. Cl.[5] ..... A43B 5/04

[52] U.S. Cl. ..... 36/117; 36/50.5; 36/120; 36/121

[58] Field of Search ..... 36/117, 118, 119, 120, 36/121, 50.5; 24/68 SK, 69 SK, 70 SK, 71 SK

[56] References Cited

U.S. PATENT DOCUMENTS

| | | | |
|---|---|---|---|
| 4,265,034 | 5/1981 | Salomon | 36/121 |
| 4,677,768 | 7/1987 | Benoit et al. | 36/117 |
| 4,761,899 | 8/1988 | Marxer | 36/121 |
| 4,802,290 | 2/1989 | Marega | 36/50.5 |
| 4,928,406 | 5/1990 | Montfort | 36/117 |
| 5,001,849 | 3/1991 | Bidioa | 36/117 |
| 5,003,710 | 4/1991 | Pozzobon | 36/117 |
| 5,065,530 | 11/1991 | Pozzobon et al. | 36/50 |
| 5,065,533 | 11/1991 | Paris | 36/117 |
| 5,136,794 | 8/1992 | Stampacchia et al. | 36/117 |

FOREIGN PATENT DOCUMENTS

| | | | |
|---|---|---|---|
| 0248149 | 12/1987 | European Pat. Off. | A43B 5/04 |
| 0278245 | 8/1988 | European Pat. Off. | A43B 5/04 |
| 0370363 | 5/1990 | European Pat. Off. | A43C 11/16 |
| 0375604 | 6/1990 | European Pat. Off. | A43B 5/04 |
| 1448831 | 7/1966 | France . | |
| 2657235 | 7/1991 | France | A43B 5/04 |
| 2657506 | 8/1991 | France | A43B 5/04 |
| 2661076 | 10/1991 | France | A43B 5/04 |

*Primary Examiner*—Paul T. Sewell
*Assistant Examiner*—Marie Denise Patterson
*Attorney, Agent, or Firm*—Sandler Greenblum & Bernstein

[57] ABSTRACT

An alpine ski boot having an arrangement for reclaiming rear support of the upper and tightening of the collar on the lower part of the leg, constituted by a link forming a dual circuit and by a latchable tensioning lever. The flexible connection describes a circuit originating from a strap of the collar constituting a mobile attachment point of one end of the link, which is thereafter freely connected to the tensioning lever, by which it transits, to be thereafter fixed by its other end on a portion of the collar constituting a fixed attachment point, from which the intermediate tensioning lever exerts a traction on the other end of the link simultaneously causing a tightening action on the strap and a latching action of the element for reclaiming rear support and vice versa.

20 Claims, 6 Drawing Sheets

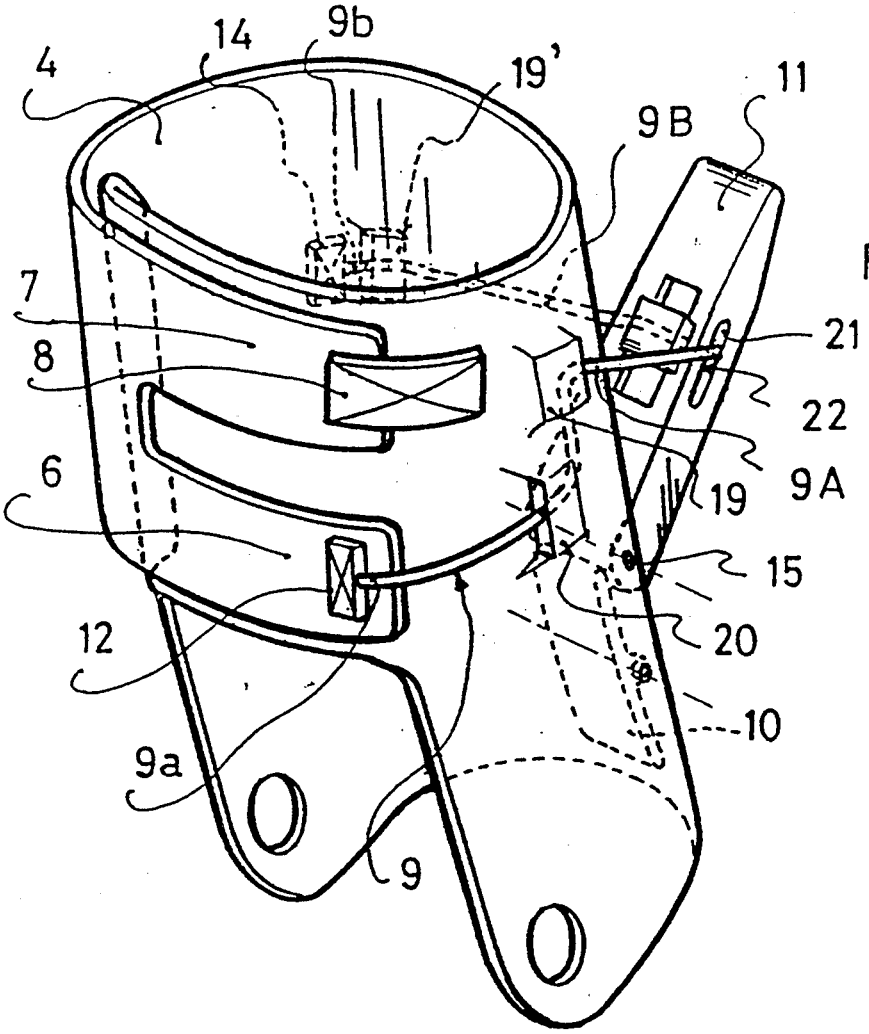
FIG. 2
FIG. 6
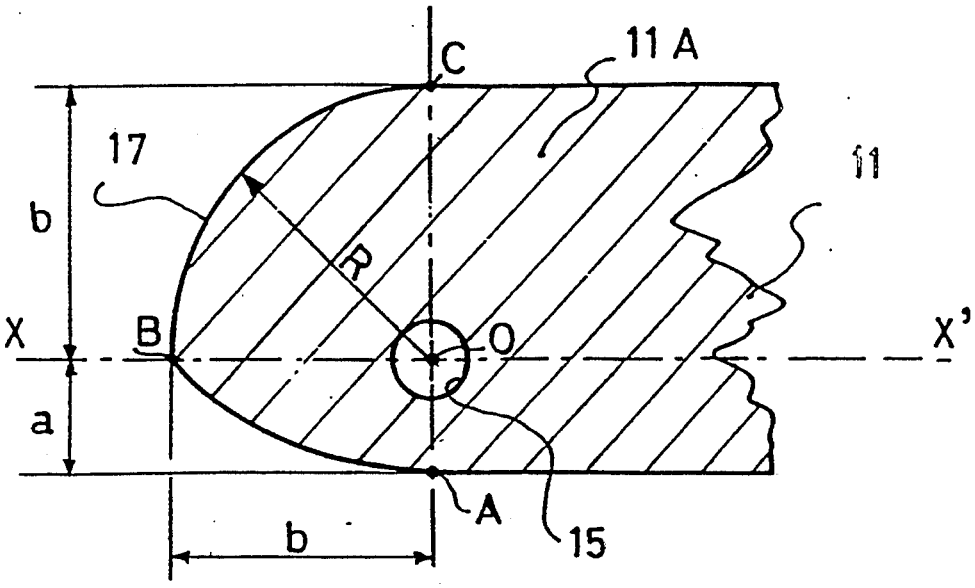

SKI BOOT HAVING A CLOSURE DEVICE

BACKGROUND OF THE INVENTION

1. Field of the Invention

The present invention is related to a central entry and/or front entry alpine ski boot comprising a shell base overlaid by an upper having at least one portion shaped like a collar journalled on the shell base in the zone of the malleoli about a rotational connection, such collar comprising at least one strap provided with a closure means adapted to simultaneously ensure the tightening of the collar on the lower part of the leg of the skier and its rotational blockage with respect to the shell base, at least in the front to rear direction, i.e., in the direction of the rear supports of the lower part of the leg on the collar.

2. Discussion of Background and Relevant Information

Such means, exerting a tightening action on both a portion of the boot and on a blocking element or the rear support element are known by the French Patent Publication No. 2,657,235.

In that application, a device is disclosed whose support element is journalled on an axis of the rear spoiler and is adapted to be placed in support on a portion of the shell base support, when the boot is closed. This support element is driven into a working position by the end of a tensioning lever during its movement towards a closure position of the boot.

This device has a certain number of disadvantages, especially insofar as it requires the positioning of elements, necessitating a very precise adjustment of the elements with respect to each other due to the fact that the support element is driven by the free end of the tensioning lever. Further, due to the fact that it is the free end of the tensioning lever which immobilizes the support element on the shell base, the lever cannot be gripped in a normal manner, i.e., by its end, but along a portion of its length.

French Patent Publication No. 2,661,076 also describes a device for simultaneous control of a closure member or buckle of a collar on a leg base and a tipping element located at the rear of the upper of the boot, capable of cooperating with an abutment of the shell base for immobilizing or releasing the upper with respect to the latter.

In this type of device, the control loop is located on the upper of the boot and it is by releasing the loop that the upper is simultaneously released from it abutment on the shell base. Such a release of the upper is especially advantageous when the skier wishes to relax and/or walk. However, due to the fact that the control member is located on a flap of the upper, a certain number of disadvantages become apparent during skiing and especially during use of skiwear that either have ski pants adapted to cover the upper, or ski pants which are adapted to be introduced into the upper. Indeed, in the first case, which is more common, it is necessary to remove the ski pants so as to gain access to the control member and in the second case, the control member is no longer protected from external agents, and can be hooked into, torn away, and even be opened, and cause accidental release of the pivotal element and thus of the upper. At any rate, whatever the skiwear used, when the control member of such device is in an open position, it is substantially in projection on the lateral external surface of the upper, increasing the risks of getting hooked to something, and especially, running the risk of having the buckle get disconnected from the flap that it controls.

Besides, due to the fact that the closure buckle is located on the upper in a lateral zone, whereas the pivotal element is in the heel zone, it is necessary to provide connection means that extend between these elements within the boot at least partially in the volume called "fitting volume" and this can obviously affect comfort.

The French Patent No. 1,448,831 also describes a boot with a monobloc upper comprising a flap having two tongues, one upper, one lower, the latter being subjected to the action of a tensioning lever by means of a flexible link exerting a traction on the tongue as well as on a portion that covers the instep constituted by a button hole. In this case, the release of the link only enables a quick loosening of the button hole, and therefore, of the foot, without producing even a partial release of the upper of the boot, for example while walking. Indeed, in such a boot, it is necessary to release the upper tongue to enable a certain movement of the lower part of the leg of the skier, and thus facilitate the use of this type of ski boot for walking.

SUMMARY OF THE INVENTION

However, it is an object of the present invention not only to resolve the above-cited disadvantages, but also to expose a problem encountered in ski boots having a collar journalled on the shell base.

Indeed, in this type of boot, the problem lies in the fact that there is too great a distancing of the covering zones originating from the closure tongues, having hooks for example, and this requires the hook system to be reset at the moment of closure because it is released during opening.

An object of the invention is to overcome all these disadvantages by proposing a simultaneous control device for loosening the upper by a rotational release thereof which is simple, accessible at all occasions, whatever type of skiwear is used, and located in a zone protected from impacts or hooking risks during skiing or walking.

Another object of the invention is to render the functioning of the device more reliable, and especially to prevent the accidentally unlatching of the upper of the boot during skiing or having it latch while walking.

The present invention enables these problems to be overcome and is related, to this end, to a central entry and/or front entry alpine ski boot comprising a shell base overlaid by an upper having at least one portion shaped like a collar journalled on the shell base and which covers at least the zones corresponding to the lower part of the leg and to the flexion fold of the ankle of the skier. Such collar, slit vertically in its front portion, is closed by means of two flaps which extend transversely with respect to the slit and which overlap, thus defining an internal flap and an external flap. According to the invention, the collar can be latched in rotation with respect to the shell base at least in the front-to-rear direction, and its external flap ensures its closure on the zones of the lower part of the leg and of the flexion fold by means of at least one closure means connecting it with the internal flap. These closure means enable the flaps to be brought closer to one another and thus tighten the collar on the lower part of the leg and on the flexion fold. The external flap comprises, to this end, a strap which extends along the flexion fold zone and which is provided with a corresponding closure means.

According to an embodiment, the collar is adjustable about the lower part of the leg of the skier by means of two straps which extend the external flap and which are respectively provided with a closure means, one upper, in the upper portion of the collar corresponding substantially to the lower part of the leg and one lower, in the junction zone with the upper edge of the shell base corresponding substantially to the flexion fold of the ankle of the skier, the latter being controlled by means of at least one flexible and inextensible link activated in traction by a tensioning lever constituting the closure means.

The boot is characterized in that the flexible link describes a circuit originating from the lower strap of the collar to be controlled during closure, the collar constituting a movable attachment point of one end of the link, which is thereafter connected freely to the tensioning lever through which the link transits, in order to be fixed thereafter by its other end on a portion of the collar constituting a fixed attachment point from which the tensioning lever, placed as an intermediary, exerts a traction on the other end of the link connected to the strap, and wherein the tensioning lever of the lower strap directly controls a rotational latching element of the collar at least in the front-to-rear direction. In this way, a tightening action of the strap on the flexion fold and a latching action of the collar by a rear support reclaiming element is caused simultaneously during maneuvering of the tensioning lever during closure, and inversely, a simultaneous release of the flexion fold and of the movement of the collar during opening.

According to another characteristic, the rotational latching element of the collar is constituted by an element journalled angularly in its central portion to form a pivoting element defining an upper arm and a lower arm and capable of taking at least two positions corresponding to the latching and unlatching of the collar on the shell base, due to the rotational action of a cam on the upper arm of the pivoting element against the thrust of a return spring on the lower arm of the pivoting element, the cam being arranged at the end of the tensioning lever opposite its free gripping end and centered on the journal axis of the tensioning lever, and its profile develops along generatrices that are parallel to the journal axis of the lever, such lever acting simultaneously in traction on the flexible link connected on the lower strap of the collar and on the upper arm of the tipping element by means of the cam. In the latching position of the collar, the tensioning lever is lowered until it takes support on the wall of the rear portion of the collar and its cam is disengaged from the upper arm of the pivoting element. The latter, due to the thrusting effect of the return spring, pivots and engages on an edge or support spoiler obtained on the shell base via its lower arm, thus obtaining an abutment at least in the front-to-rear pivoting direction for the collar. In the unlatched position of the collar, the tensioning lever is raised in an angular manner by a value corresponding at least to the disengagement of the lower arm of the pivoting element outside the support edge of the shell base. This minimum angular value is determined in correlation with the release of the tightening of the flexion fold obtained by means of the lower closure strap of the collar such that the tensioning lever is maintained in this unlatched position simply by the residual tension or the relative stiffness of the flexible link rendered sensitive due to the release of the lower strap which is loosened. This minimum unlatching position of the collar in which the lower strap is released is appropriate for walking and relaxation because the skier can straighten the lower part of his leg which is no longer blocked in an angular manner with respect to the shell base.

According to a preferred embodiment, the tensioning lever is provided with an elongate opening through which the flexible link passes, the link taking support, on the one hand, on the end of the slot which is closest to the journal axis in the closure position and, on the other hand, on the end of the slot which is furthest away from the journal axis in the maximum raised position of the tensioning lever. In cooperation with this elongate slot, returns of the flexible link are located between the lower strap and the rear portion of the collar where the tensioning lever is journalled in such a way that in the raised maximum position thereof, the end of the slot which is furthest away from its journal is located across from the returns. This arrangement of the returns and of the slot of the tensioning lever enables a constant release of the flexible link during complete opening of the collar to be obtained, whatever the position of the end of the slot that is closest to the journal of the tensioning lever, which end constitutes the support zone of the link for its tensioning. It is of course understood that the support zone can also be constituted by other means such as a slide, adjustable in position along the slot in order to adjust the active length of the flexible link.

It is apparent from the structure described that the tensioning lever/latching element/lower strap assembly is very stable in the closure position because a simple shock on the tensioning lever is not enough to unlatch the collar. Indeed, the latter being maintained blocked by means of the pivoting element due to the action of the return spring, it is necessary to subject the tensioning lever to a relatively substantial rotation before disengaging the lower arm of the pivoting element from its support on the shell base, and this can only be done by a voluntary maneuver.

To summarize, and as will be better understood from the description that follows, the arrangement of the link is such so as to enable loosening, without release, of the lower strap of the collar in order to provide to the instep and to the flexion fold, the amplitude of movement necessary for walking, without necessitating loosening of the upper strap. Moreover, during a complete release of the lower strap, during opening or removal of the boot, the latter is never completely released, but benefits only from a certain degree of freedom obtained by releasing the link, which constitutes a controlled retention of the external flap of the collar, and as such, of the lower flap. As is apparent, the permanent connection of the link with the lower strap renders possible the easy closure of the base of the upper and thereby, induces a partial tightening of the top of the upper enabling the upper strap to be reset very easily to its closure means after the upper has been opened.

BRIEF DESCRIPTION OF THE DRAWINGS

The invention will be better understood and other characteristics thereof will become clearer upon reading the description that follows, with reference to the annexed schematic drawings, illustrating, as a non-limiting example, how the invention can be obtained and wherein:

FIG. 2 is a perspective view of a collar that can equip the boot of FIG. 1, the collar being provided with the device as per the invention;

FIG. 6 is a partial enlarged sectional view of the cam of the device for reclaiming rear support.

DETAILED DESCRIPTION OF THE PREFERRED EMBODIMENTS

Figure 1:
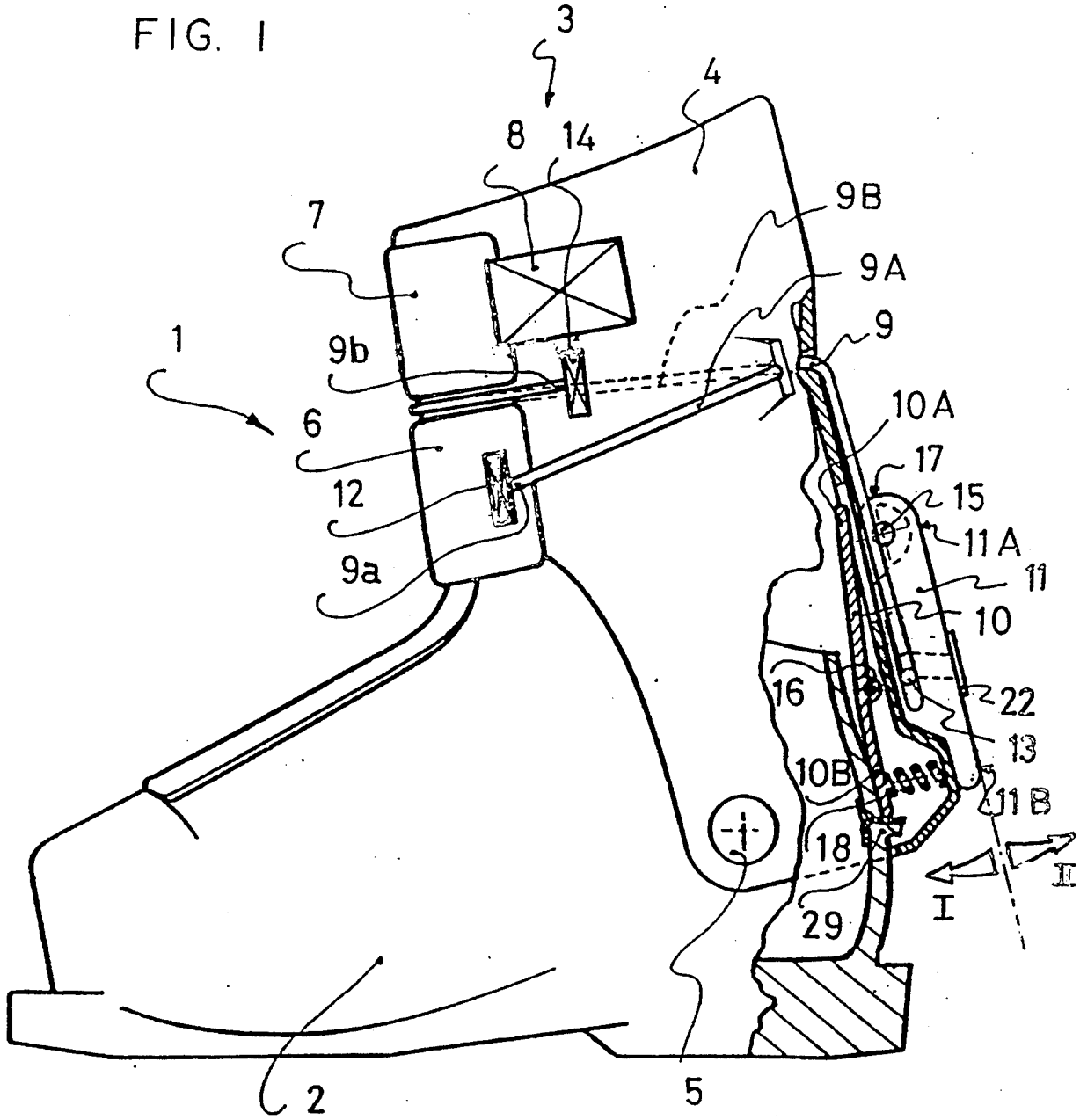
FIG. 1 is a side view of a ski boot comprising a device for tightening the upper and for reclaiming support thereof, as per the invention.

As a non-limiting example, FIG. 1, the boot designated in its entirety by the reference numeral 1, is of the front and/or central entry type and comprises a shell base 2 overlaid by an upper 3 having at least one portion shaped like a collar 4, journalled on the shell base 2 in the zone of the malleoli about a rotational connection 5. In a known manner, such collar 4 includes an exterior overlapping portioned positioned frontwardly of the lower leg of the skier, and; is adjustable about the lower part of the leg of the skier via two straps or tongues 6, 7. The lower strap is located in the junction zone with the upper edge of the shell base 2 corresponding substantially to the flexion fold of the ankle of the skier, whereas the upper strap 7 is located in the top portion of collar 4 and comprises closure means that are specific to it and that are constituted by a hook or buckle 8, represented schematically, since it is already well known.

The second lower strap 6 comprises, as per the invention, a closure means which is constituted-by a flexible and inextensible link 9 which is connected to a latching element 10 for rearwardly supporting the collar 4 on shell base 2 and which is controlled in traction by a tensioning lever 11, placed as an intermediary, acting simultaneously on link 9 and on element 10.

The flexible link 9 defines a dual circuit 9A–9B originating from strap 6 of collar 4 constituting a mobile attachment point 12 of one end 9*a* of a portion 9A of the closed dual circuit by link 9, the link is thereafter connected freely to tensioning lever 11 by a hole 13 from which it transits to be thereafter fixed by its other end 9*b* of a branch 9B of the circuit, on a portion of collar 4 to constitute a fixed attachment point 14, from which the intermediate tensioning lever 11 exerts a traction on the other end 9*a* of circuit 9A of link 9 connected to strap 6. In this way, lever 11 simultaneously exerts a tightening action on a strap 6 and a latching action on the latching element 10.

Preferably, such as illustrated in FIG. 2, link 9 describes a dual circuit 9A–9B, passing on either side of the collar 4, its passage on the external side of the collar ending at the attachment point 12 on strap 6 and its passage on the internal side of the collar ending at a fixed attachment point 14 located on the internal side, substantially at the same height as return 19'.

In the embodiment of FIG. 1, the fixed attachment point 14 is located on the external flap of collar 4, after having detoured the internal flap thereof and its front opening zone. This arrangement substantially improves the tightening quality of collar 4 on the lower part of the leg but requires a substantially greater release of link 9 than the construction of FIG. 2 in order to enable an optimum opening of the collar in view of putting on and removal of the boot.

Indeed, the flexible link 9 is assembled in a non-removable manner along a predetermined length which would ensure a partial release of collar 4 via strap 6.

Figure 4:
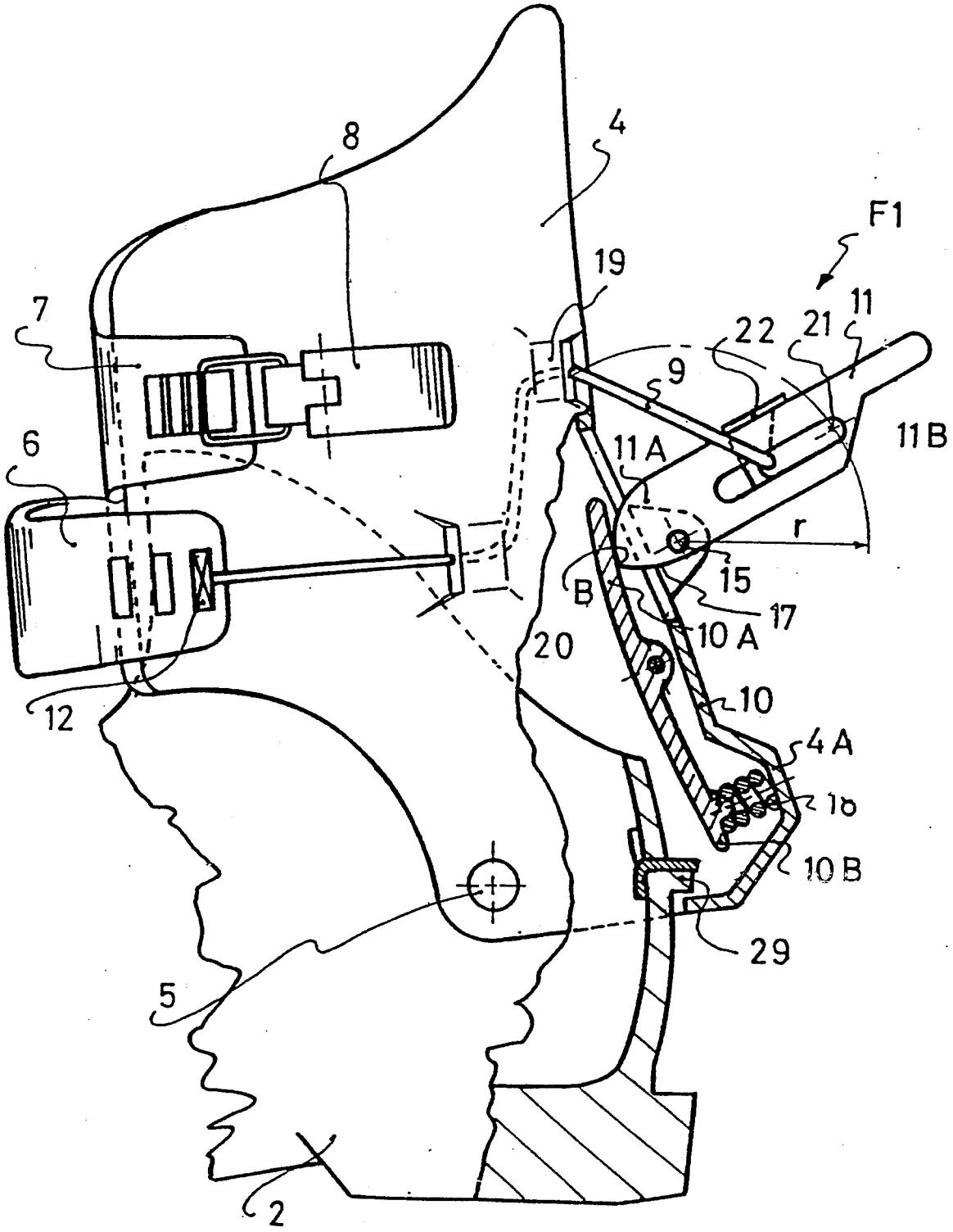
Figure 5:
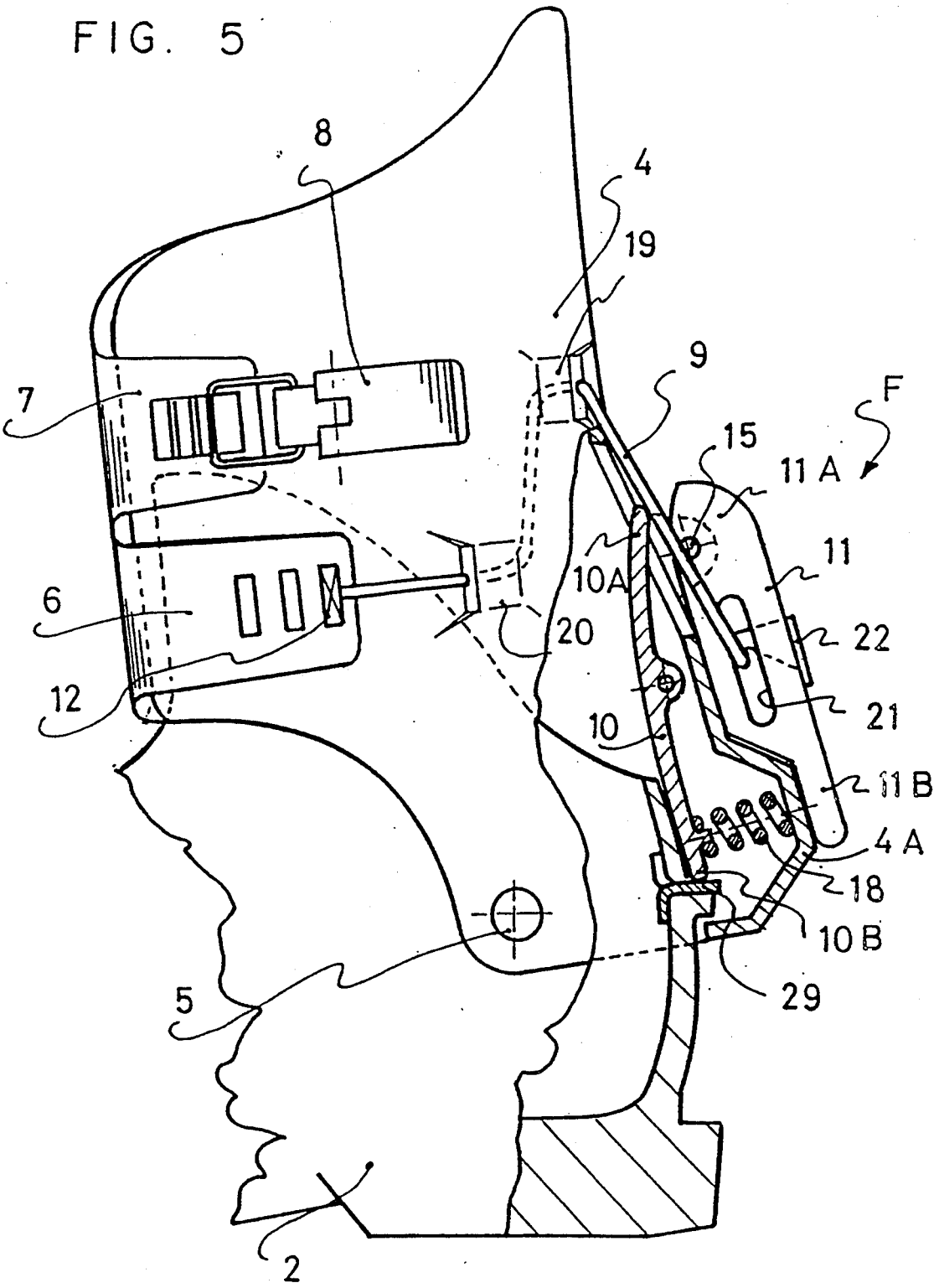

This partial release defined by the position F1 of tensioning lever 11 is appropriate for walking as is illustrated in FIG. 4. Advantageously, in this case, upper strap 7 can remain closed to maintain a certain retention of the lower part of the leg without necessitating the disengagement of the pants of the ski clothes for example.

Figure 3:
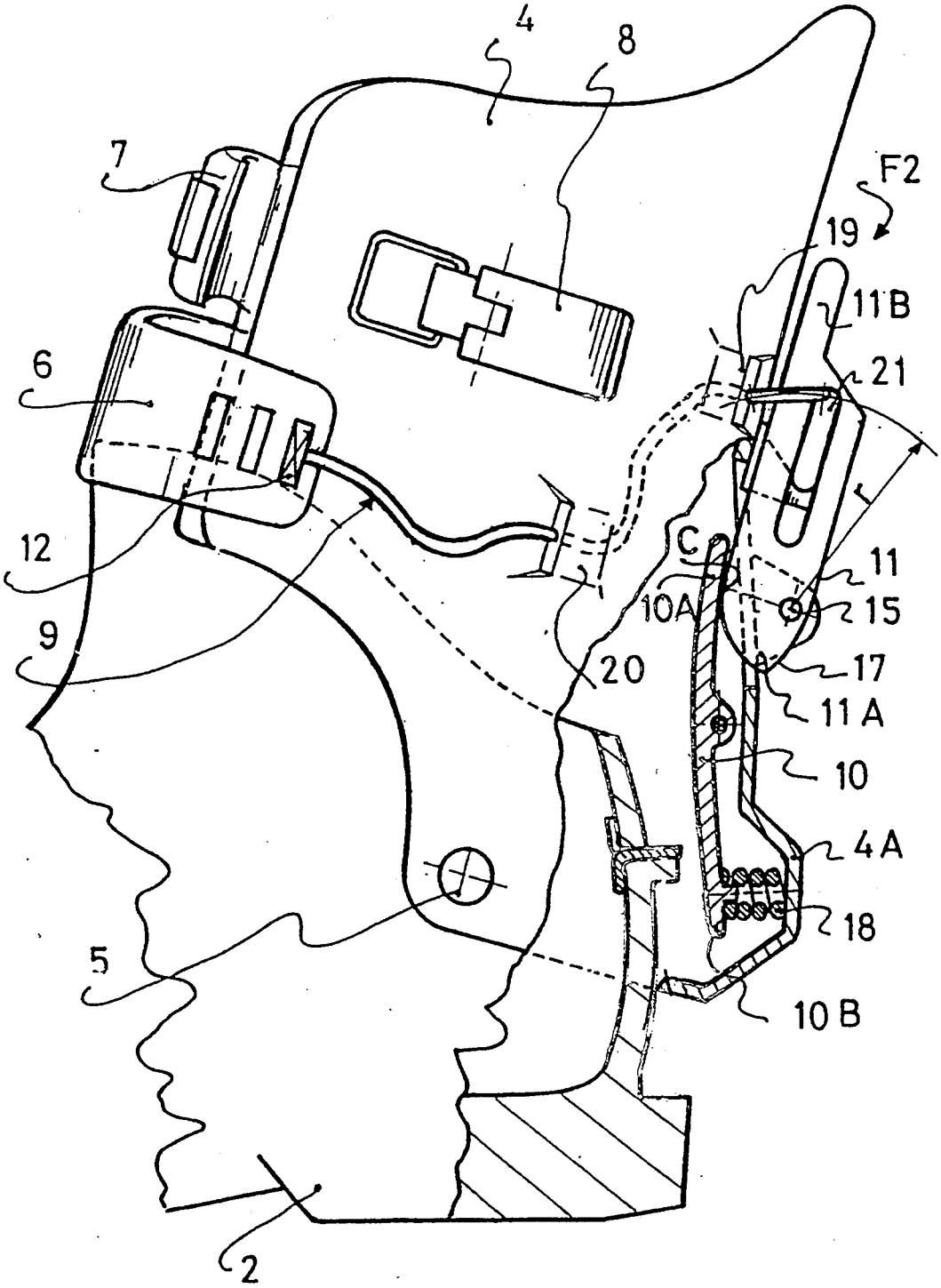
FIGS. 3, 4 and 5 are side views of the boot of FIG. 1, respectively representing the device and the collar of FIG. 2 in the open position, the walking position and in the closed position.

A more substantial release defined by the position F2 of the tensioning device (FIG. 3) associated with the opening of the upper strap 7 is appropriate for putting on and removal of the boot. In this position F2, link 9 deriving from dual circuit 9A–9B is placed in abutment on the end of slot 21 which is furthest away from journal 15 of tensioning lever 11, substantially across from returns 19—19' of the link 9 on the rear portion of collar 4. This arrangement enables a constant release of flexible link 9 to be obtained during opening of collar 4 and independently of the support position of the link 9 on the end of slot 21 which is closest to journal 15 of the lever and/or a slide 22 for adjustment of the active length. To obtain this result at the opening of collar 4, it is necessary that returns 19—19' and the end of slot 21 which is furthest away from journal 15 be located from each other as explained hereinabove. This implies that the transverse journal axis 15 of tensioning lever 11 should be located on the rear portion of the collar at a distance "r" of returns 19—19' equivalent to the distance "r" separating it from the end of slot 21 which is closest to journal 15. If the flexible link 9 deriving from lower strap is too low, as is visible in the examples of FIGS. 2–5 for example, it is obvious that one would need to use a guide or a return to raise the link 9 to the correct height.

According to a preferred embodiment, the latching element 10 reclaiming the rear support 10 is constituted by an element journalled in an angular manner in its central portion 16 to form a tipping or pivotal element defining an upper arm 10A and a lower arm 10B and capable of taking at least two positions, e.g., latching position F and unlatching positions F1–F2 of collar 4 with respect to the shell base 2, under the rotational action of a cam surface 17 which is exerted on the upper arm 10A of pivotal element 10, the cam surface 17 being arranged concentrically with journal 15 at end 11A of tensioning lever 11 opposite the free gripping end 11B.

Further, a return spring 18 is interposed between the lower arm 10B of pivotal element 10 and a rear portion 4A of collar 4 to ensure the automatic return of the pivoting element 10 into the latching position when it is no longer biased by cam surface 17 of tensioning lever 11.

Finally, the lower arm 10B of pivotal element 10 is capable of taking support, in a latched position F, against a rear edge 29 of shell base 2, thereby reclaiming support of the upper with respect to the shell base.

Figure 7:
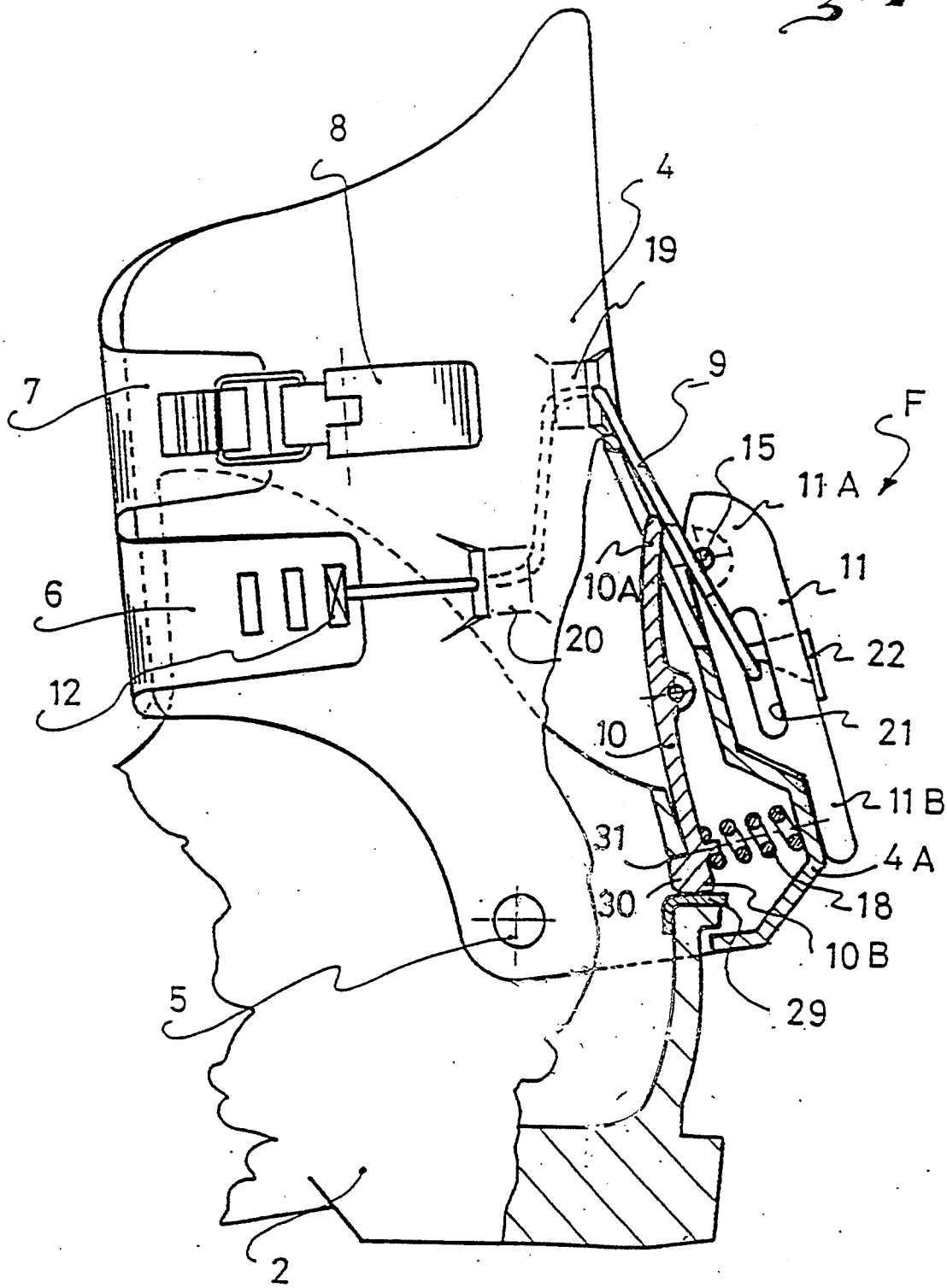
FIG. 7 is a side view of another embodiment of the invention.

It is understood that the rear support or pivotal element 10 of collar 4 can be provided to also ensure the blocking of the rotation of the collar 4 in the rear-to-front direction. In an example of such a construction, shown in FIG. 7, the lower arm 10B of the pivoting element has a jaw 30 directed towards the wall of shell base 2 which is then extended beyond edge 29 described previously, and the wall is provided with a nesting cutout 31 corresponding to the jaw. In this way, when the tensioning lever 11 is brought to the lowered position, the lower am 10B of pivoting element 10 is pushed back by spring 18 against the wall of shell base 4 and is engaged by its jaw 30 with the cutout 31. By providing a tight adjustment of the jaw with the cutout, a total rotational latching of collar 4 is obtained with respect to shell base 2. On the other hand, by obtaining a vertically elongate cutout, namely by providing a certain space between the jaw and two vertical ends of the cutout, collar 4 will be capable of a certain rotation whose amplitude is determined by such space.

With reference to FIG. 6, the description of the profile of cam 17, as well as the activation mode of pivoting element 10, will now be provided.

The profile of cam 17 of tensioning lever 11 comprises:

a first zone comprised between, on the one hand, a point A projecting perpendicularly with respect to longitudinal axis X—X' of lever 11 from center O of its journal axis 15, and according to a predetermined value a, the point A not influencing the upper arm 10A of pivoting element 10 which is located, by its lower arm 10B in the latching position F against abutment 29 for reclaiming support on shell base 2, by the action of return spring 18, and on the other hand, a point B located on the longitudinal axis X—X' of lever 11, intersecting segment OA to form a segment OB having a value b greater than the value a of segment OA, so that when the point B is in contact with the upper arm 10A of pivoting element 10 for an unlatched position F1, the arm 10B is pushed back by a value corresponding substantially to the engagement of the lower arm 10B on abutment 29 of shell base 2 with the compressing of the return spring 18.

a second zone comprised between point B and a point C diametrically opposed to point A with respect to center O, the zone BC having a radius of curvature which is substantially constant R=OB, the point C, when it is in contact with the upper arm 10B of pivoting element 10, corresponding to a complete retracted position of the tensioning lever 11 in an unlatched position F2.

The instant application is based upon French patent application 92.07761 of Jun. 22, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a shell base having an abutment at a rear portion;

an upper comprising a collar for surrounding a lower leg of a skier, said collar further comprising:

an upper strap having a first closure device for facilitating closing of the upper about the lower leg, said upper strap located in an upper portion of said collar; and a lower strap, having a second closure device for facilitating closing of the upper about the lower leg, said lower strap having a portion located in a zone proximate to an upper edge of said shell base substantially corresponding with a flexion fold area of the ankle of the skier;

means for journalling said collar with respect to said shell base about a transverse axis in an area of the malleoli of the skier;

a latching mechanism, located at a rear portion of said collar, for selectively latching and unlatching said collar in rear support with respect to said shell base by means of said abutment of said shell base;

a tensioning lever mounted for movement at a rear portion of the ski boot, said tensioning lever having a cam for engagement with and for controlling movement of said latching mechanism;

at least one inextensible and flexible link extending in a predeterminate circuit, whereby said link has a first end affixed as a mobile attachment point to said lower strap, said link extending to and being connected to said tensioning lever, said link extending from said tensioning lever and having a second end affixed to a portion of said collar at a fixed attachment point;

said tensioning lever, said link and said latching mechanism comprising, upon movement of said tensioning lever in a closing direction to a predeterminate latched position and upon application of a traction force to said link by movement of said tensioning lever and upon a forward pivotal movement of said collar about said shell base:

means for simultaneously (1) tightening said collar on the lower leg of the skier by means of a tightening movement of said mobile attachment point of said lower strap; and (2) latching said collar in rear support with respect to said shell base by means of said abutment of said shell base, said tensioning lever being in said predeterminate latched position concurrently with said collar being latched in rear support with respect to said shell base.

2. A ski boot according to claim 1, wherein:

said tensioning lever, said link and said latching mechanism comprise, upon movement of said tensioning lever in a direction away from said latched position to a partial release position:

means for simultaneously (1) loosening said collar by means of a movement of said mobile attachment point of said lower strap in a direction away from a direction of said tightening movement of said mobile attachment point; and (2) unlatching said collar from rear support with respect to said shell base and from said abutment of said shell base, wherein said link remains in said predeterminate circuit, whereby said first end of said link and said second end of said link remain affixed both in said partial release position and in said latched position of said tensioning lever.

3. A ski boot according to claim 1, wherein:

said predeterminate circuit of said link comprises a dual circuit, one branch of said dual circuit extending on one lateral side of said collar and a second branch of said dual circuit extending on a second lateral side of said collar to form at least a partial loop around said collar, whereby said tensioning lever and said link comprise, upon movement of said tensioning lever in said closing direction and upon application of said traction force to said link by movement of said tensioning lever:

means for closing said loop upon itself for providing a uniform tightening of said collar on the lower leg of the skier.

4. A ski boot according to claim 1, further comprising:

a closure for engagement with said upper strap of said collar, said link not being directly affixed to said closure and said upper strap, said closure being selectively positionable in (1) an engaged position, whereby said upper strap is closed upon the remainder of said collar upon which said upper strap overlaps, and (2) a disengaged position, whereby said upper strap is opened from engagement with the remainder of said collar for facilitating the lower leg and foot of the skier to be inserted and withdrawn from the ski boot.

5. A ski boot according to claim 1, further comprising:

means for mounting said tensioning lever for pivoting about a pivot axis on a rear portion of said collar between said latched position, in which a manipulable end of said tensioning lever extends downwardly from said pivot axis, and a maximum release position, in which said manipulable end of said tension lever extends upwardly from said pivot axis, whereby said tensioning lever and said link comprise, upon movement of said tensioning lever in a direction away from said latched position to said maximum release position:

means for loosening said collar by means of a movement of said mobile attachment point of said lower strap in a direction away from said tightening movement of said mobile attachment point for moving said lower strap to a maximum release position for facilitating the lower leg and foot of the skier to be inserted and withdrawn from the ski boot.

6. A ski boot according to claim 1, further comprising:

means for mounting said tensioning lever for pivoting about a pivot axis fixed at said rear portion of said collar, said tensioning lever having a manipulable end at one side of said tensioning lever pivot axis, extending for manipulation by the skier, and said cam being at a second side of said tensioning lever pivot axis;

said latching mechanism comprises a pivotal element mounted for pivoting about a transverse axis at said rear portion of said collar for latching and unlatching said collar in rear support with respect to said shell base by means of said abutment of said shell base;

a pivot axis extending transversely of said element in a central portion of said element to define an upper arm and a lower arm, said pivotal element being movable between a latching position and an unlatching position, said cam of said tensioning lever being engageable with said upper arm of said pivotal element of said latching mechanism in said unlatching position of said pivotal element, said cam having at least a surface portion centered on said pivot axis of said tensioning lever.

7. A ski boot according to claim 6, further comprising:

a return spring positioned between said lower arm of said pivotal element of said latching mechanism and extending to a portion of said collar rearward of said pivotal element for biasing said pivotal element toward said latching position.

8. A ski boot according to claim 6, wherein:

said lower arm of said pivotal element of said latching mechanism is in engagement with said abutment of said shell base in said latching position of said pivotal element, said abutment comprising a rear edge of said shell base.

9. A ski boot according to claim 6, wherein:

said lower arm of said pivotal element comprises a jaw extending toward said shell base and said abutment of said shell base comprises an opening for receiving said jaw of said lower arm.

10. A ski boot according to claim 7, wherein:

said tensioning lever comprises a longitudinal axis extending from said manipulable end through said tensioning lever pivot axis;

said cam comprising:

a first surface of said tensioning lever extending from (1) a first point on one side of said tensioning lever, said first point projecting from said pivot axis of said tensioning lever in a direction perpendicular to said longitudinal axis, said first point being spaced a first predetermined distance from said tensioning lever pivot axis and, in said latched position of said tensioning lever said first point being spaced away from said upper arm of said pivotal element of said latching mechanism, and (2) a second point on said tensioning lever located on said longitudinal axis, said second point being spaced a second predetermined distance from said tensioning lever pivot axis, said second predetermined distance being greater than said first predetermined distance and, in said unlatched position of said tensioning lever said second point engaging said upper arm of said pivotal element of said latching mechanism, whereby movement of said manipulable end of said tensioning lever in a direction toward engagement of said second point of said tensioning lever with said pivotal element of said latching mechanism causes disengagement of said latching mechanism from said abutment of said shell base.

11. A ski boot comprising:

a shell base;

an upper comprising a collar for covering a front part and a rear part of a lower leg of a skier, said collar having an exterior overlapping portion positioned frontwardly of the lower leg of the skier, said overlapping portion further comprising an upper strap and a lower strap, a first closure device for closing said upper strap against an underlying portion of said collar and a second closure device for closing said lower strap against the underlying portion of said collar;

means for journalling said collar with respect to said shell base about a transverse axis in an area of the malleoli of the skier; and means for (1) tightening said collar on the lower leg of the skier and (2) latching said collar to said shell base comprising:

a latching element mounted at a rear portion of said collar for movement between a latching position and an unlatching position, said latching element having an engagement portion for engagement with an engagement portion of said shell base in said latching position;

means for biasing said latching element toward said latching position;

a tensioning lever having a manipulable end for engagement by the skier and a cam for engagement with said latching element for opposing a biasing force of said biasing means for moving said latching element to said unlatching position, means for mounting said tensioning lever for movement between (1) a released position, in which said cam is in engagement with said latching element and said latching element is in said unlatching position with said portion of said shell base, and (2) a closed position, in which said cam is not in engagement with said latching element and said latching element is said latching position with said portion of said shell base by means of said biasing means; and an inextensible and flexible link, said link having a first end affixed as a mobile attachment point to said lower strap of said collar, said link extending to and being connected to said tensioning lever, said link extending from said tensioning lever and having a second end affixed to a portion of said collar at a fixed attachment point.

12. A ski boot comprising:

a shell base;

an upper comprising a collar for covering a front part and a rear part of a lower leg of a skier, said collar having an exterior overlapping portion positioned frontwardly of the lower leg of the skier, said overlapping portion further comprising an upper strap and a lower strap, a first closure device for closing said upper strap against an underlying portion of said collar and a second closure device for closing said lower strap against the underlying portion of said collar;

means for journalling said collar with respect to said shell base about a transverse axis in an area of the malleoli of the skier;

a latching element mounted at a rear portion of said collar within said collar, means for mounting said latching element about a pivot axis for movement between a latching position and an unlatching position, said latching element having an engagement portion for engagement with an engagement portion of said shell base in said latching position of said latching element;

a spring positioned between said latching element and said collar for biasing said latching element in said latching position;

a tensioning lever having a manipulable end for engagement by the skier, said manipulable end extending away from an external surface of said collar, said tensioning lever further having a cam for engagement with said latching element for opposing a biasing force of said means for biasing for moving said latching element to said unlatching position, means for mounting said tensioning lever for movement between (1) a released position, in which said cam is in engagement with said latching element and said latching element is in said unlatching position with said portion of said shell base, and (2) a closed position, in which said cam is not in engagement with said latching element and said latching element is said latching position with said portion of said shell base by means of said spring;

at least one inextensible and flexible link, said link having a first end affixed as a mobile attachment point to said lower strap of said collar, said link extending to and being connected to said tensioning lever, said link extending from said tensioning lever and having a second end affixed to a portion of said collar at a fixed attachment point;

said tensioning lever, said link and said latching element comprising, upon movement of said tensioning lever toward said closed position and upon application of a traction force to said link upon said movement of said tensioning lever:

means for simultaneously (1) tightening said collar on the lower leg of the skier by moving said mobile attachment point of said lower strap in a tightening direction; and (2) latching said collar to said shell base, said tensioning lever being in said closed position concurrently with said collar being latched to said shell base.

13. A ski boot according to claim 12, wherein:

said tensioning lever, said link and said latching element comprise, upon movement of said tensioning lever in a direction away from said closed position to a partial release position:

means for simultaneously (1) loosening said collar by means of a movement of said mobile attachment point of said lower strap in a direction away from a direction of said tightening movement of said mobile attachment point; and (2) unlatching said collar with respect to said shell base.

14. A ski boot according to claim 12, wherein:

said predeterminate circuit of said link comprises a dual circuit, one branch of said dual circuit extending on one lateral side of said collar and a second branch of said dual circuit extending on a second lateral side of said collar to form at least a partial loop around said collar, whereby said tensioning lever and said link comprise, upon movement of said tensioning lever toward said closed position and upon application of said traction force to said link by said movement of said tensioning lever:

means for closing said loop upon itself for providing a uniform tightening of said collar on the lower leg of the skier.

15. A ski boot according to claim 12, further comprising:

a buckle for engagement with said upper strap of said collar, said link not being directly affixed to said buckle and said upper strap, said buckle being selectively positionable in (1) an engaged position, whereby said upper strap is closed upon the remainder of said collar upon which said upper strap overlaps, and (2) a disengaged position, whereby said upper strap is opened from engagement with the remainder of said collar for facilitating the lower leg and foot of the skier to be inserted and withdrawn from the ski boot.

16. A ski boot according to claim 12, further comprising:

means for mounting said tensioning lever for pivoting about a pivot axis between said closed position, in which said manipulable end of said tensioning lever extends downwardly from said pivot axis, and a maximum release position, in which said manipulable end of said tensioning lever extends upwardly from said pivot axis, whereby said tensioning lever and said link comprise, upon movement of said tensioning lever in a direction away from said closed position to said maximum release position:

means for loosening said collar by means of a movement of said mobile attachment point of said lower strap in a direction away from said tightening movement of said mobile attachment point for moving said lower strap to a maximum release position for facilitating the lower leg and foot of the skier to be inserted and withdrawn from the ski boot.

17. A ski boot according to claim 12, further comprising:

means for mounting said tensioning lever for pivoting about a pivot axis, said pivot axis being fixed with respect to said collar, said manipulable end of said tensioning lever being at one side of said tensioning lever pivot axis and said cam being at a second side of said tensioning lever pivot axis;

said latching element defining an upper arm and a lower arm on either side of said latching element pivot axis, said cam of said tensioning lever being engageable with said upper arm of said pivotal element of said latching element in said unlatching position of said latching element, said cam having at least a surface portion centered on said pivot axis of said tensioning lever.

18. A ski boot according to claim 17, wherein:

said engagement portion of said latching element comprises an end of said lower arm of said latching element; and said engagement portion of said shell base comprises an abutment surface of said shell base for engagement with said end of said lower arm of said latching element.

19. A ski boot according to claim 17, wherein:

said engagement portion of said latching element comprises a jaw formed on said lower arm of said pivotal element, said jaw extending toward said shell base; and said engagement portion of said shell base comprises an opening for receiving said jaw of said lower arm.

20. A ski boot according to claim 17, wherein:

said tensioning lever comprises a longitudinal axis extending from said manipulable end through said tensioning lever pivot axis;

said cam comprising:

a first surface of said tensioning lever extending from (1) a first point on one side of said tensioning lever, said first point projecting from said pivot axis of said tensioning lever in a direction perpendicular to said longitudinal axis, said first point being spaced a first predetermined distance from said tensioning lever pivot axis and, in said closed position of said tensioning lever said first point being spaced away from said upper arm of said pivotal element of said latching element, and (2) a second point on said tensioning lever located on said longitudinal axis, said second point being spaced a second predetermined distance from said tensioning lever pivot axis, said second predetermined distance being greater than said first predetermined distance and, in said released position of said tensioning lever said second point engaging said upper arm of said latching, whereby movement of said manipulable end of said tensioning lever in a direction toward engagement of said second point of said tensioning lever with said latching element causes disengagement of said portion of said latching element mechanism from said portion of said shell base.

* * * * *